United States Patent [19]

Terrel

[11] 4,349,865

[45] Sep. 14, 1982

[54] LAMP MOUNTING

[75] Inventor: Christopher Terrel, London, England

[73] Assignee: Chloride Group Public Limited Company, London, England

[21] Appl. No.: 165,409

[22] Filed: Jul. 2, 1980

[30] Foreign Application Priority Data

Apr. 3, 1980 [GB] United Kingdom ..... 8011389

[51] Int. Cl.[3] ..... F21V 21/14

[52] U.S. Cl. ..... 362/250; 362/282; 362/283; 362/287; 362/417; 362/419; 362/426; 362/430

[58] Field of Search ..... 362/250, 282, 283, 287, 362/417, 419, 426, 430

[56] References Cited

U.S. PATENT DOCUMENTS 3,519,811 7/1970 Jacobs ..... 362/426

*Primary Examiner*—Stephen J. Lechert, Jr.

*Attorney, Agent, or Firm*—Oblon, Fisher, Spivak, McClelland & Maier

[57] ABSTRACT

An adjustable lamp mounting assembly for two lamps 12, 12A, which are each connected to a body 10 by a pair of arcuate rods 14. The arcuate rods 14 of lamp 12 each fit snugly into one of a pair of slots 16 formed in a face 18 of the body 10. The rods are retained in the slots 16 against the ends of the slots by a single resilient spring strip 20, which lies on the opposite side of the face 18 to the lamp 12. The resilience of the spring strip 20 holds the arcuate rods 14 against the ends of the slots. The arcuate members 14 can slide in the slots 16, in the direction shown by arrow 26 to rotate the lamp 12. The arcuate rods 14 are connected to the lamp 12 by a pair of housings 22, and the lamp 12 is mounted to turn about bearings in the housings 22 about the pivot axis 24.

13 Claims, 2 Drawing Figures

LAMP MOUNTING

BACKGROUND OF THE INVENTION

1. Field of the Invention

This invention relates to an adjustable mounting assembly for a lamp or other components, enabling it to be easily adjusted over a wide range of attitudes.

2. Description of the Prior Art

There have of course been many proposals for mounting various components through universal joint mountings, but they have tended to be either rather expensive, or rather unreliable, and it is an object of the present invention to provide a swivel mounting which is easy and stable to use but which is yet quite economical to produce.

According to the present invention, an adjustable mounting for a lamp or other component, includes a support having at least one slot in an external face and an arcuate member carrying the lamp and being snugly fit in the slot, and a fastener retaining the arcuate member in the slot but permitting the lamp to be adjustable by longitudinal or rotational movement of the arcuate member along or through the slot. Preferably there are two slots in the external face, the second slot being parallel to, and in side-by-side relationship with the one slot, and a further arcuate member parallel with the first, and carried by the lamp and being a snug fit in the second slot.

Even if the slot is a simple rectangular slot cut in sheet material constituting the external face if its width is equal to that of the arcuate member, and the arcuate member is partly circular, adjustment about an axis through the centre of the part circle and at right angles to the length of slot can be quite simple and yet quite precise. While a single arcuate member in a single slot may be arranged to prevent movement about the axis of the length of the slot, the preferred arrangement with the second arcuate member and slot can eliminate any tendency for movement about such an axis.

The fastener is conveniently a spring steel strip or other resilient member merely acting to hold the arcuate member or members firmly in the slot or slots.

The lamp or other component is conveniently positioned within the arc defined by the arcuate member or members, and mounted for pivoting about an axis parallel with the plane of an arcuate member by virtue of a pair of journal bearing housings held one at each end of the arcuate member or members, and housing a corresponding journal at each side of the lamp.

In one arrangement there are two lamps mounted on respective external faces of a single body, the faces being in different planes, and that gives a very wide range of possible arrangements.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
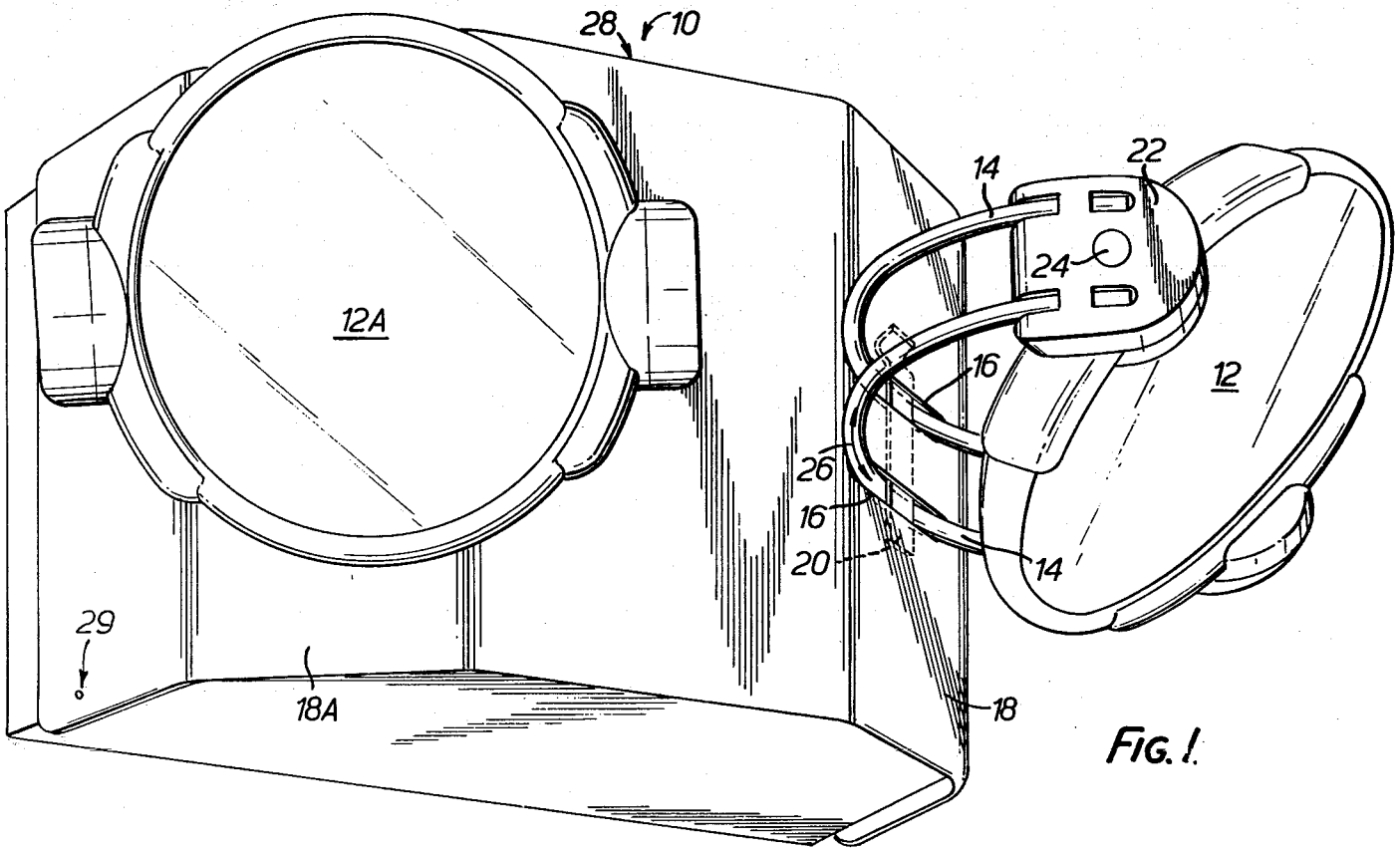
FIG. 1 is an isometric view of a sheet metal body 10 with two lamps 12, 12A mounted on it.
Figure 2:
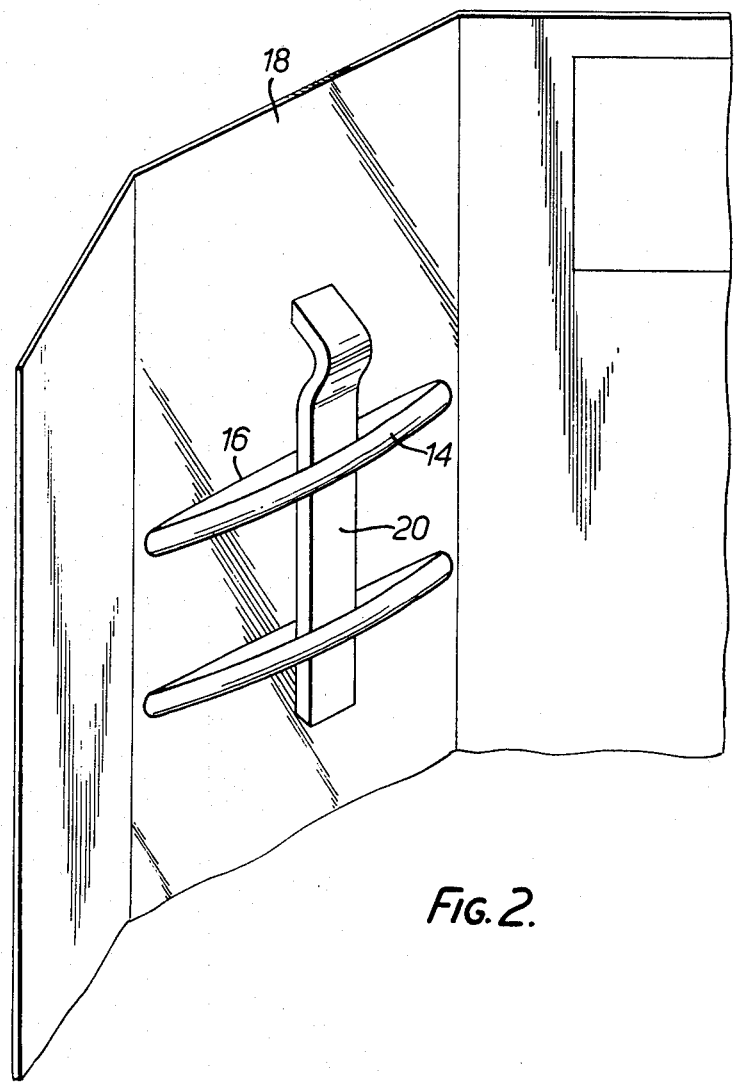
FIG. 2 is a sketch from the back of one lamp mounting.

Each lamp is mounted on the body 10 by a pair of rods 14 of circular arcuate shape. For convenience only the mounting for one lamp 12 is shown. The arcuate or partly circular rods 14 each fit snugly in one of a pair of slots 16 formed in a face 18 of the body 10. The rods are retained in the slots 16 against the ends of the slots by a single resilient spring strip 20, which lies underneath the face 18, on either side of the slots as shown in chain lines, and passes over the arcuate rods 14 where they lie in the slots 16 as is shown in FIG. 2. The strip 20 has to be sprung into position so that its resilience holds the rods 14 against the ends of the slots. The rods can be adjusted against frictional spring restraint about a vertical axis containing the centres of the circular area, which is on a horizontal pivot axis 24.

The arcuate rods 14 are connected at either side of the lamp 12 to a housing 22. The lamp is mounted to turn about bearings in the housings 22 which define the pivot axis 24.

When the body 10 is mounted on a wall, for example, each lamp 12 can be rotated about its pivot axis 24, and the arcuate members 14 can slide in the slots 16, in the directions shown by the arrow 26, until the desired area is illuminated.

The lamp 12A is mounted on a face 18A of the body 10, the face 18A being in a different plane from the face 18, thus enabling a greater possible combination of illuminating position to be achieved.

The device is particularly useful for battery-operated emergency lighting systems which are designed to operate as soon as the mains supply fails. The power for the lights comes from a battery housed inside the body 10, and the lamps are used to illuminate areas of particular importance for example exits from a room or hazardous areas.

The body 10 carries a volt-meter and a indicator switch (not shown).

Although the arrangement is very simple requiring for each lamp only two rectangular slots in the face 18, the spring strip 20, and the housings 22 into which the ends of the rods 14 fit, there is a wide range of positions of adjustment. After removal of a screw at position 28, the front of the body 10 can be pivotted downwards about a horizontal axis 29 in relation to the rest of the body to allow access to the battery.

There may be a casing concealing much of the rods 14 and bearing housings 22. The mounting will be quite firm if the thickness of the face 18 is substantial, say 1/10 or ¼ of the diameter of the rods.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An adjustable mounting assembly for at least one lamp comprising:

a support body having an external face and at least one slot formed in said external face;

at least one arcuate member upon which the lamp is mounted; and fastener means operatably associated with said support body for retaining said at least one arcuate member against opposite end portions of said at least one slot to permit the at least one arcuate member to move longitudinally in relation to the ends of the at least one slot to adjust the lamp angularly.

2. A mounting as claimed in claim 1 wherein the at least one arcuate member further comprises an arcuate member of substantially the same width as the at least one slot.

3. A mounting as claimed in claim 1 or 2 wherein the external face of said support body is of a thickness which is substantial enough to support said lamp via said at least one arcuate member and said fastener means.

4. A mounting as claimed in claim 1 or 2 wherein the fastener means further comprises a resilient strip member which cooperably engages a back portion of the external face and engages a front portion of the at least one arcuate member when the at least one arcuate member is retained against the opposite end portions of the slot.

5. A mounting as claimed in claim 1, wherein the at least one slot further comprises a first and second slot formed in the external face of the support body, wherein the second slot is parallel to, and in side-by-side relationship with, the first slot and wherein said at least one arcuate member further comprises a first and second arcuate member restrained against opposite end portions of said first and second slot, respectively, and wherein said second arcuate member is oriented parallel to said first arcuate member.

6. A mounting as claimed in claim 1, further comprising at least one bearing housing connected to the at least one arcuate member and defining an axis substantially at right angles to the axis of angular adjustment produced by longitudinal movement of the at least one arcuate member alone the slot wherein the lamp is connected to the at least one bearing housing.

7. A mounting as claimed in claim 6 wherein the at least one bearing housing further comprises a first and second bearing housing, the first and second bearing housings being connected to the at least one arcuate member at opposite ends thereof and the first and second bearing housings defining an axis substantially at right angles to the axis of angular adjustment produced by longitudinal movement of the at least one arcuate member along the at least one slot and wherein the at least one lamp comprises a first and second lamp connected to said first and second bearing housings, respectively.

8. A mounting as claimed in claim 6 or claim 7, further comprising means for positioning the lamp within an arc defined by the at least one arcuate member.

9. An ajustable mounting assembly for at least a first and second lamp comprising:

a support body having a first and second external face and at least one slot formed in each of said first and second external faces;

at least one arcuate member upon which each of said first and second lamps is mounted; and fastener means operably associated with said support body for retaining each of said at least one arcuate members against opposite end portions of said at least one slot to permit each of said at least one arcuate members to move longitudinally in relation to the ends of each of said at least one slots to adjust each of the first and second lamps angularly.

10. An adjustable mounting for a lamp comprising:

a support body including a pair of sapced edges;

at least a first partly-circular member upon which the lamp is mounted and defining an adjustment axis;

fastener means for retaining said first member on the support against the pair of spaced edges to permit the partly-circular member to move longitudinally, but not rotatably, in relation to the support body and the fastener means to adjust the lamp angularly.

11. A mounting as claimed in claim 10, wherein said at least first partly circular member further comprises a first and second partly-circular member upon which the lamp is mounted, the second member being parallel to, and in side-by-side relationship with the first member.

12. A swivel mounting for a lamp including a support including a pair of spaced edges, a first part-circular member for carrying the lamp and defining a swivel axis, and fastener means for retaining said first member on the support against the edges to permit the part-circular member to move longitudinally, but not rotatably, in relation to the support and the fastener means to swivel the lamp.

13. A swivel mounting as claimed in claim 12 including a second part-circular member for carrying the lamp, the second member being parallel to, and in side by side relationship with the first member.

* * * * *